US006695726B1

(12) United States Patent
Kuhn

(10) Patent No.: US 6,695,726 B1
(45) Date of Patent: Feb. 24, 2004

(54) ARROW BLADE LOCKING SYSTEM

(76) Inventor: Todd A Kuhn, 5660 Bob White Trail, Mims, FL (US) 32754

( * ) Notice: Subject to any disclaimer, the term of this patent is extended or adjusted under 35 U.S.C. 154(b) by 0 days.

(21) Appl. No.: 10/364,781

(22) Filed: Feb. 11, 2003

(51) Int. Cl.[7] ..... A63B 65/02
(52) U.S. Cl. ..... 473/584; 473/583
(58) Field of Search ..... 473/584, 583

(56) References Cited

U.S. PATENT DOCUMENTS 3,614,103 A * 10/1971 Carroll ..... 473/584
3,915,455 A * 10/1975 Savora ..... 473/584
4,210,330 A * 7/1980 Kosbab ..... 473/584
4,986,550 A * 1/1991 Segovia ..... 473/584
5,102,147 A * 4/1992 Szeluga ..... 473/584
5,354,068 A * 10/1994 Maleski ..... 473/584
5,482,294 A * 1/1996 Sullivan et al. ..... 473/584
5,931,751 A * 8/1999 Cooper ..... 473/583
6,077,180 A * 6/2000 Adams, Jr. ..... 473/584

* cited by examiner

*Primary Examiner*—Derris H. Banks
*Assistant Examiner*—Urszula M Cegielnik

(57) ABSTRACT

The present invention is a system of locking arrow blades that provide excellent main shaft rotation without producing a large amount of aerodynamic drag. This system, including a plurality of v-shaped blades, is attached to the forward end of any conventional arrow shaft or integral to the forward end of any conventional arrow shaft.

2 Claims, 3 Drawing Sheets

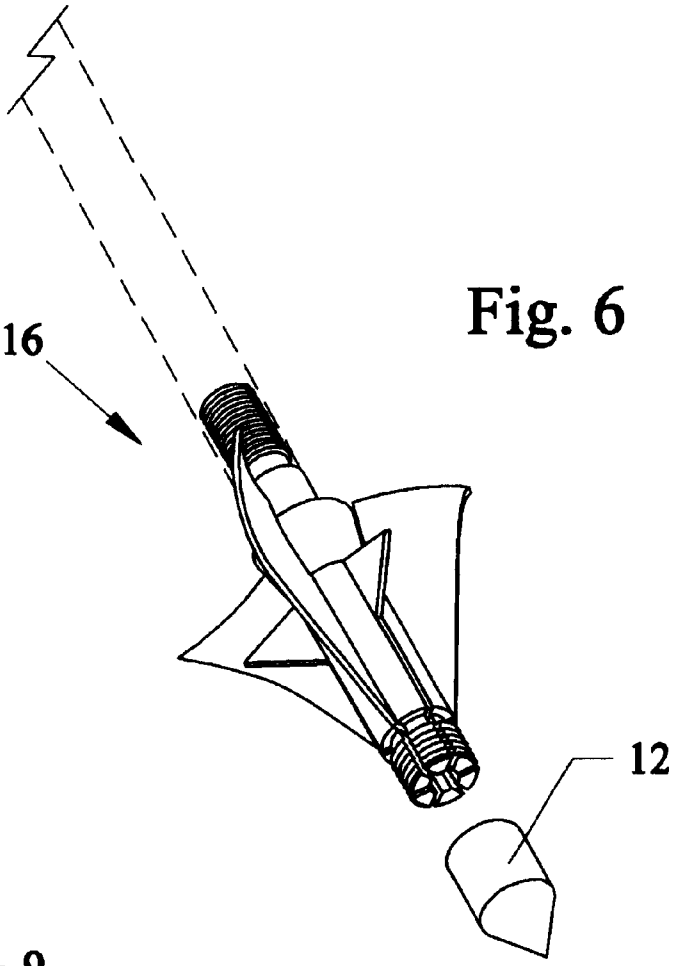
Fig. 6
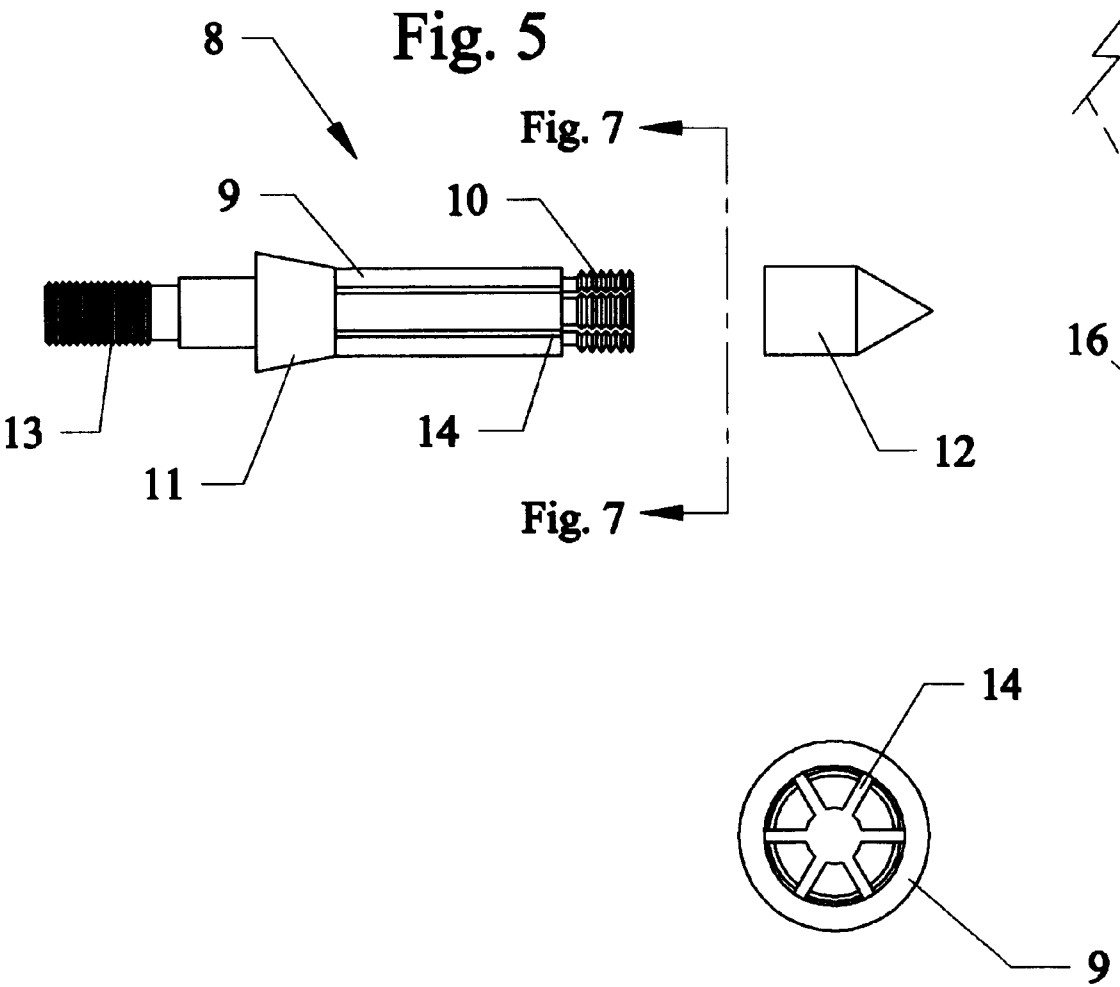
Fig. 5
Fig. 7

ARROW BLADE LOCKING SYSTEM

BACKGROUND OF THE INVENTION

1. Field of the Invention

The present invention relates to the field of archery. Specifically, the invention relates to the blades found on arrow devices.

2. Description of the Prior Art

Bowhunting and archery rely on arrows to have two key properties. First, arrows must achieve penetration of the intended target regardless of whether that intended target is a static bulls-eye or a hunted animal. Second, arrows must fly straight and true. Even the most skilled of archers, with the most trained eyes, can not compensate for an arrow that can not find its intended mark. These two great needs are somewhat at odds with one another.

Historical solutions have sought to balance these two needs in order to minimize the detrimental effects of each while maximizing the overall result.

The problem of target penetration has been addressed in several ways. Target penetration can be directly correlated to the likelihood of hunting success: an arrow that can not adequately penetrate an intended animal is of little use to a hunter. The overall mass of the arrow could be increased, but more massive arrows are clumsy and must be fired in a high arc to reach the intended target. Simple "field point" arrow tips can provide adequate penetration for straw targets in competition, but they are not very effective for killing hunted animals. Prior art broadhead arrows were invented to increase effective hunting penetration and success potential. Typically two to four flat, triangular blades are arranged around the forward pointed tip. As the tip enters the intended target, the blades slice a region much greater than the diameter of the arrow shaft. Unfortunately, these broad, flat blades have a pronounced aerodynamic effect that can radically impact the overall stability of the arrow in flight and significantly reduce the precision of flight.

Fletching, or other guidance fins, were added to the aft end of prior art arrows. Typically, two to four fins are applied parallel to the long axis of the arrow surrounding the aft end. As the arrow sails through the air, these fins are intended to straighten the overall flight path by effectively pushing the tip of the arrow in the right direction. However, these same fins typically account for sixty percent of the overall aerodynamic drag experienced by the arrow in flight. Fins of reduced size have less drag but also provide less overall stability. Minimizing drag is important to increase overall range and speed at impact.

Broadhead blades are also easily damaged during use. Poorly anchored broadhead blades, which can be removed and replaced, may dislodge during impact with a target. If replaced blades are not perfectly symmetrical, i.e., misapplied, with respect to the remaining blades, then the arrow will not fly accurately. Conversely, permanently attached blades are always symmetrical, but they can not be replaced at all without replacing the entire arrow head assembly.

SUMMARY OF THE INVENTION

The present invention is a system of locking arrow blades that provide excellent main shaft rotation without producing a large amount of aerodynamic drag. A system including a plurality of v-shaped blades is attached to the forward end of any conventional arrow shaft or integral to the forward end of any conventional arrow shaft. The invention is compatible with all contemporary arrow shafts.

The individual blades of this novel system include two key features. A first key feature of the present invention is the geometry of the blades wherein the leading edge of each blade is parallel to the long axis of the arrow shaft, and the trailing edge of each blade is deflected out of the plane of the blade in a smooth, continuous arc. All blades of the present invention are identical with all deflected portions facing the same direction when the arrow is viewed down its long axis. In flight, the arrow rotates as a result of airflow over the deflected portion of the blades much as the control surface on an aircraft wing changes the direction of the aircraft if said control surface is deflected out of the major plane of the aircraft wing. However, said blades being fashioned of smooth metal create little aerodynamic drag. The second key feature of the present invention is the robust manner in which each blade locks into the assembly, thereby providing simple, positive, accurate removal and installation of replacement blades.

BRIEF DESCRIPTION OF THE DRAWINGS

FIG. 5 is a side view of the arrow head body of present invention.

FIG. 6 is an oblique view of the assembled invention.

FIG. 7 is a rear-facing view of the body of the present invention.

DESCRIPTION OF THE PREFERRED EMBODIMENTS

Figure 1:
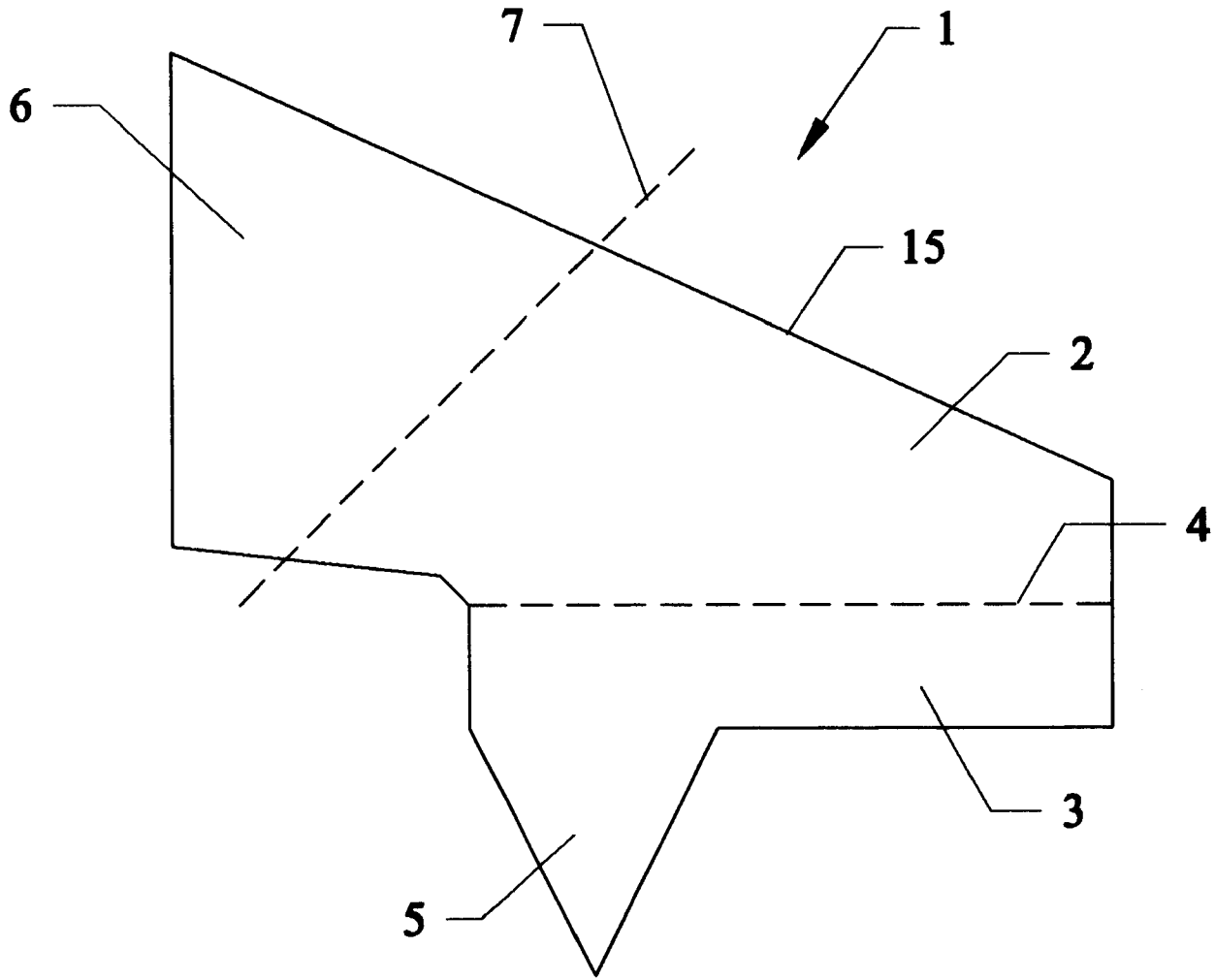
FIG. 1 is a two-dimensional view of an arrow blade of the present invention, depicting all the elements of said blade.

FIG. 1 is directed to one of the plurality of removable/replaceable blades of the present invention as shown in two dimensions. Arrow blade 1 consists of a trapezoidal major portion 2 and an irregularly shaped minor portion 3. Major portion 2 and minor portion 3 are separated from one another by longitudinal fold 4.

The aft part of major portion 2 further comprises an extended control surface 6 that is continuous with the remainder of major portion 2 and contributes to the overall trapezoidal geometry of major portion 2. Control surface 6 is deflected out of the plane of the remainder of major portion 2 in order to direct air flow over arrow blade 1 in a manner that causes the entire arrow to rotate. Control surface 6 extends longitudinally substantially beyond the length of minor portion 3 in the preferred embodiment. The leading edge 15 of major portion 2 is sharpened and slopes continuously up from fore to aft of arrow blade 1.

The aft part of minor portion 3 further comprises a radially extended, sharp-edged triangular minor blade 5. Minor blade 5 is greatly reduced in size relative to either major portion 2 or control surface 6 in order to minimize interaction with the rotational airflow generated by control surface 6. Minor blade 5 and the remainder of minor portion 3 are coplanar in the preferred embodiment.

Figure 4:
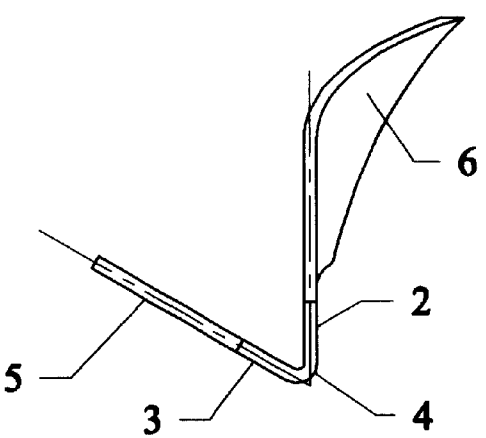
FIG. 4 is a third view of the three-dimensional blade of the present invention.
Figure 3:
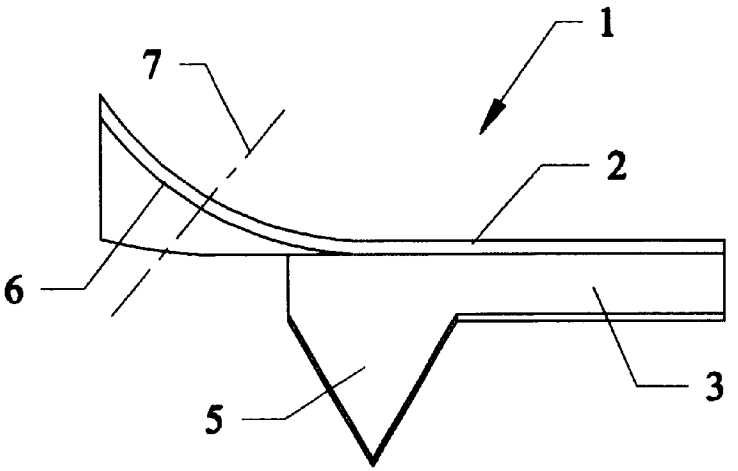
FIG. 3 is a second view of the three-dimensional blade of the present invention.
Figure 2:
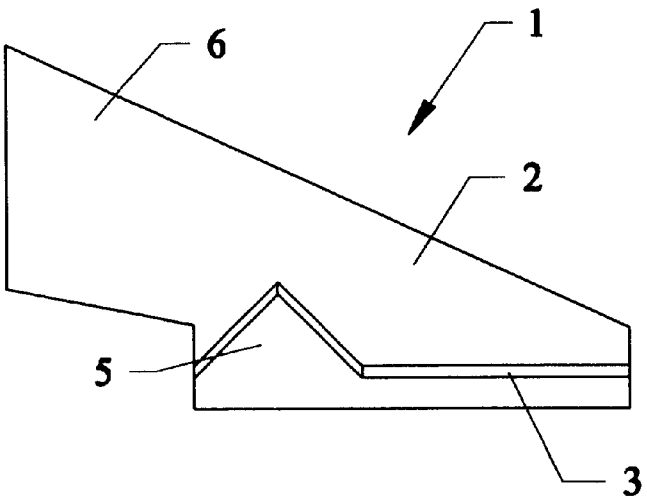
FIG. 2 is first view of the three-dimensional blade of the present invention.

FIGS. 2–4 describe the three-dimensional geometry of arrow blade 1 once it is formed into its final configuration.

FIGS. 2 and 4 show major portion 2 and minor portion 3 bent along fold 4. In this exemplary embodiment, elements 2 and 3 are bent to a 60-degree "V" shape. FIGS. 3 and 4 show control surface 6 arched out of the plane of major portion 2. In order for the system of the present invention to function correctly, all blades must be formed into the same three-dimensional geometry. Arrow blade 1 may be manufactured from any material known in the art of producing arrow blades. The preferred material is steel due to its ability to maintain a keen edge, its high strength to weight ratio, and its ability to retain a folded shape.

FIG. 5 depicts the main body of the present invention. Arrowhead body 8 comprises a main cylindrical housing 9 which further comprises a male-threaded forward end 10 and a flared trailing end 11. Said forward end 10 is of slightly reduced diameter so that when a conical, female-threaded tip 12 is attached, the maximum diameters of tip 12 and cylindrical housing 9 are equal. Trailing end 11 is flared so that the maximum diameter of trailing end 11 is equal to the maximum diameter of the arrow shaft (reference only). Aft of trailing end 11, and integral with the rest of arrowhead body 8 is a coupling means 13 which attaches the present invention to a prior art arrow shaft. Typically, coupling means 13 will be a male-threaded cylinder of the type well known in the art of attaching arrowheads to arrow shafts. However, coupling means 13 could also easily be a press/friction fit or a cylindrical mating surface of slightly reduced diameter attached to the prior art arrow shaft by any mechanical bonding means such as adhesives or pinning. Arrowhead body 8 may be manufactured from metal, plastic, ceramic, or composite materials.

A plurality of longitudinal channels 14 extend from the forward-most surface of forward end 10 completely through forward end 10 and through approximately 75% of the length of cylindrical housing 9. Said channels 14 extend to a depth in cylindrical housing 9 equal to the length of minor portion 3. There must be an even number of channels 14 in order to accept the folded arrow blades also of the present invention. The exemplary embodiment of the present invention includes six channels 14 capable of employing three folded arrow blades. The blades must therefore be folded along fold 4 such that elements 2 and 3 are bent to a 60-degree "V" shape. In an alternative embodiment including only four channels, the blades must be folded along fold 4 such that elements 2 and 3 are bent to a 90-degree "V" shape. As a rule, the number of channels 14 is equal to twice the number of arrow blades 1, and the angle between elements 2 and 3 is equal to 360° divided by twice the number of arrow blades 1.

The width of channels 14 must be equal to the thickness of arrow blade 1 so that each of said arrow blades 1 can be slid down into two adjacent channels 14 in cylindrical housing 9. Minor portion 3 must have a height equal to or greater than the depth of longitudinal channels 14 in order to properly lock each blade in place. In the preferred embodiment, minor portion 3 is of a height equal to the depth of channels 14 with the exception of minor blade 5 which extends further radially outward. Once all arrow blades are installed, i.e., all channels are filled, tip 12 is screwed down over forward end 10 to complete the assembly. FIG. 6 shows a completed assembly 16 of the present invention.

The embodiments described herein are meant to be exemplary of the present invention and not limiting in scope.

What is claimed is:

1. An arrow blade locking system comprising:

a cylindrical housing having a forward end and a trailing end;

a conical tip that can be removably attached to said forward end;

a coupling means, integral to said trailing end, capable of attaching said arrow blade locking system to an arrow; and a plurality of blades;

wherein said housing further comprises a plurality of longitudinal channels extending from the forward-most surface of said forward end completely through said forward end and through approximately 75% of the length of said cylindrical housing;

wherein the number of said channels is equal to twice the number of said blades, and the width of said channels is equal to the thickness of said blades;

wherein each said blade further comprises a major portion and a minor portion separated by a longitudinal fold such that the angle between said major portion and said minor portion is equal to three-hundred sixty degrees divided by twice the number of said blades;

wherein said major portion of each said blade is substantially parallel to the long axis of the arrow shaft, and the trailing control surface of each major portion is deflected out of the plane of the blade in a smooth, continuous arc;

wherein said minor portion has a height equal to or greater than the depth of said longitudinal channels; and wherein one of said blades is installed in each pair of said longitudinal channels until all channels are filled prior to attachment of said conical tip.

2. The system of claim 1, wherein the aft part of said minor portion further comprises a radially extended, sharp-edged triangular minor blade of reduced size relative to said major portion.

* * * * *